US011391037B2

(12) United States Patent
Hale et al.

(10) Patent No.: US 11,391,037 B2
(45) **Date of Patent: *Jul. 19, 2022**

(54) LIFTING AN ASSEMBLED WALL MODULE INTO POSITION FOR ATTACHMENT TO A BUILDING STRUCTURE

(71) Applicant: RBD HOLDINGS LLC, Alexander, AR (US)

(72) Inventors: Robert Hale, Alexander, AR (US); David Reed, Hensley, AR (US)

(73) Assignee: RBD HOLDINGS LLC, Alexander, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/082,770

(22) Filed: Oct. 28, 2020

(65) Prior Publication Data

US 2021/0372118 A1 Dec. 2, 2021

Related U.S. Application Data

(60) Provisional application No. 63/031,268, filed on May 28, 2020.

(51) Int. Cl.
*E04B 1/35* (2006.01)
*E04G 21/14* (2006.01)

(52) U.S. Cl.
CPC ..... *E04B 1/355* (2013.01); *E04G 21/142* (2013.01); *E04B 2001/3588* (2013.01)

(58) Field of Classification Search
CPC ..... E04B 1/355; E04B 2001/3588; E04G 21/142; E04G 21/167; Y10S 269/904; Y10S 269/905; Y10S 269/91; Y10S 269/909; E04F 21/1894; E04F 21/1805
See application file for complete search history.

(56) References Cited

U.S. PATENT DOCUMENTS 2,465,206 A * 3/1949 Davis ..... E04F 21/1822 414/11
2,785,814 A * 3/1957 Corley ..... B62B 3/04 414/458
2,828,869 A * 4/1958 Corley ..... E04G 21/167 414/11
3,314,553 A * 4/1967 Vircks ..... E04F 21/1822 414/11
3,782,771 A * 1/1974 Moore ..... B66C 23/48 294/67.22
3,977,534 A * 8/1976 Blake ..... E04F 21/1894 414/11
4,591,308 A * 5/1986 Imai ..... B66C 13/08 414/11
4,796,350 A * 1/1989 French ..... B27F 7/003 227/119
4,815,395 A * 3/1989 Trueg ..... B65G 49/062 108/115
5,640,826 A * 6/1997 Hurilla, Jr. ..... E04F 21/1805 414/11
5,732,527 A * 3/1998 Schneider ..... E04F 21/1822 52/749.1
5,833,430 A * 11/1998 Reynolds ..... E04G 21/168 414/11

(Continued)

*Primary Examiner* — Rodney Mintz
(74) *Attorney, Agent, or Firm* — Haynes and Boone, LLP

(57) ABSTRACT

An apparatus, system, and method for lifting an assembled wall module into position for attachment to a building structure.

15 Claims, 15 Drawing Sheets

(56) References Cited

U.S. PATENT DOCUMENTS 6,000,898 A * 12/1999 Sharp ..... B66F 3/00 414/11
6,010,299 A * 1/2000 Jesswein ..... B66F 5/00 254/8 R
7,494,312 B2 * 2/2009 Valette ..... E04F 21/1822 280/79.7
8,185,240 B2 * 5/2012 Williams ..... B25J 15/0019 901/41
8,317,454 B1 * 11/2012 Parker ..... B28D 7/043 414/770
8,776,478 B2 * 7/2014 Hovenier ..... E04B 1/35 52/745.1
8,966,860 B2 * 3/2015 Hovenier ..... E04G 21/167 52/745.11
9,297,174 B2 * 3/2016 Ventling ..... E04B 1/355
9,322,187 B1 * 4/2016 Burrell ..... E04G 21/168
9,903,118 B2 * 2/2018 Ventling ..... E04G 21/14
10,100,541 B1 * 10/2018 Widjaja ..... E04G 21/168
10,550,587 B2 * 2/2020 Marcon ..... E04F 21/18
11,261,598 B2 * 3/2022 Hale ..... E04G 21/142
2004/0182019 A1 * 9/2004 Flynn ..... E04F 21/1805 52/127.2
2010/0057242 A1 * 3/2010 Williams ..... B27F 7/006 700/114
2013/0199110 A1 * 8/2013 Sias ..... B66C 1/62 52/125.2
2013/0269284 A1 * 10/2013 Hovenier ..... E04G 21/167 52/745.11
2013/0269285 A1 * 10/2013 Hovenier ..... E04G 21/167 52/745.11
2016/0053502 A1 * 2/2016 Phillip ..... E04G 21/18 294/67.1
2016/0258162 A1 * 9/2016 Ventling ..... E04B 2/56
2018/0274248 A1 * 9/2018 Marcon ..... E04F 21/18
2019/0047828 A1 * 2/2019 Connell ..... E04G 15/04
2021/0310263 A1 * 10/2021 Zhang ..... B25J 11/0055
2021/0372133 A1 * 12/2021 Hale ..... E04B 2/56
2021/0404173 A1 * 12/2021 Hale ..... E04B 1/355

* cited by examiner

LIFTING AN ASSEMBLED WALL MODULE INTO POSITION FOR ATTACHMENT TO A BUILDING STRUCTURE

CROSS-REFERENCE TO RELATED APPLICATION

The present application claims the benefit of the filing date of, and priority to, U.S. Application No. 63/031,268 (the "'268 Application"), filed May 28, 2020, the entire disclosure of which is hereby incorporated herein by reference.

TECHNICAL FIELD

The present application relates generally to wall systems and, more particularly, to an apparatus, system, and method for lifting an assembled wall module into position for attachment to a building structure.

BACKGROUND

The standard construction methodology for insulated metal panel ("IMP") cladding over a steel stud wall involves labor-intensive aerial construction of the stud wall followed by a similar construction process to install the metal panels. Most of this work must be performed by workers in boom lifts or other aerial working platforms with the materials being maneuvered into place using cranes. This standard construction methodology is an established, tried, and true process with known challenges and rate of work. However, such working conditions present serious fall risks for workers. Additionally, the workers are encumbered with 50-75 lbs. of gear while working and spend approximately half of their time getting into position to perform the work. Thus, the inefficiencies of working at a height that requires fall protection result in a prolonged job schedule. Therefore, what is needed is an apparatus, system, and/or method to address one or more of the foregoing issued, and/or one or more other issued.

BRIEF DESCRIPTION OF THE DRAWINGS

FIG. 2A-2 is a perspective view of the lifting apparatus of FIG. 2A-1 in the first operational state or configuration, according to one or more embodiments.

FIG. 2A-3 is an elevational view of the lifting apparatus of FIG. 2A-1 in the first operational state or configuration, according to one or more embodiments.

FIG. 2B-1 is a diagrammatic illustration of the lifting apparatus of FIG. 2A-1 in a second operational state or configuration, the lifting apparatus having been actuated from the first configuration to the second configuration by a crane, according to one or more embodiments.

FIG. 2B-2 is a diagrammatic illustration of the lifting apparatus of FIG. 2A-1 in the second operational state or configuration, the lifting apparatus having been actuated from the first configuration to the second configuration by one or more hydraulic cylinders, according to one or more embodiments.

FIG. 2B-3 is a perspective view of the lifting apparatus of FIG. 2B-1 in the second operational state or configuration, according to one or more embodiments.

FIG. 2B-4 is an elevational view of the lifting apparatus of FIG. 2B-1 in the second operational state or configuration, according to one or more embodiments.

DETAILED DESCRIPTION

The present disclosure introduces a modularized wall system that allows for entire wall modules to be constructed at ground level by workers without the need for fall protection. Most of the work of constructing the wall modules is done at ground level, resulting in the modularized wall system of the present disclosure being safer than the standard construction methodology described above by reducing the fall risk to the level of normal tripping hazards inherent to all construction activity. Further, workers are not required to wear heavy fall protection restraints or carry tools on their person, resulting in the modularized wall system of the present disclosure being more efficient than the standard construction methodology described above by enabling workers to get into position to perform their work in seconds rather than minutes. Further still, the modularized wall system of the present disclosure allows a portion of the structural work to be pre-fabricated ahead of time at an off-site location, resulting in the modularized wall system of the present disclosure being more efficient than the standard construction methodology described above. To achieve these advantages (and others), the modularized system of the present disclosure requires careful planning to prepare for the risks and challenges.

Figure 1A:
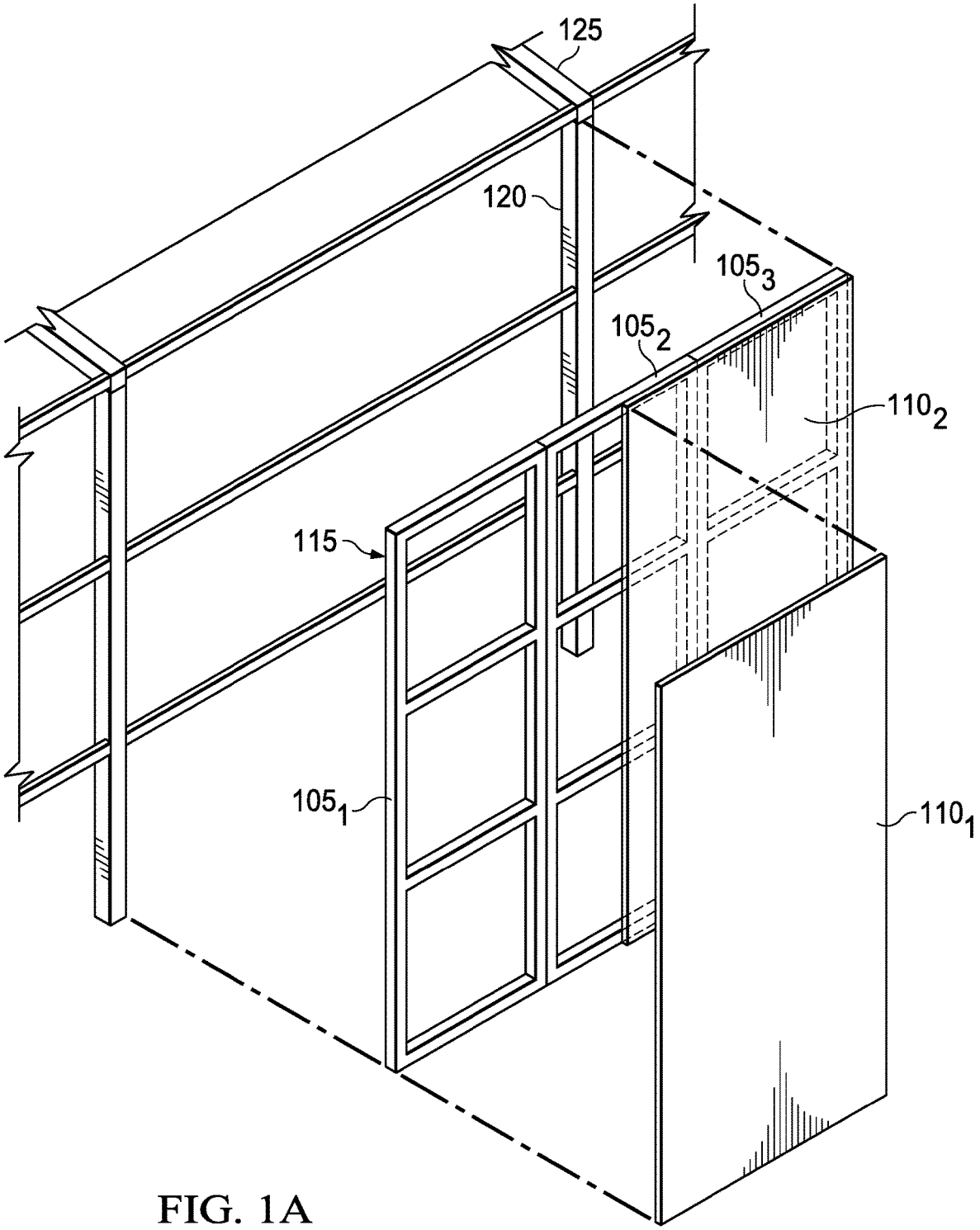
FIG. 1A is a simplified exploded perspective view of a building structure, a building substructure, and a wall module including framing sections and sheeting sections, according to one or more embodiments.
Figure 1B:
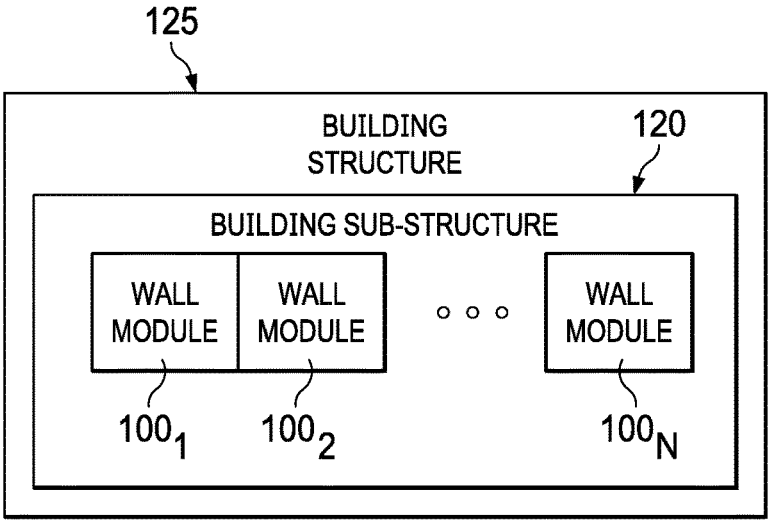
FIG. 1B is a diagrammatic illustration of the wall module of FIG. 1A installed onto the building sub-structure, according to one or more embodiments.
Figure 1C:
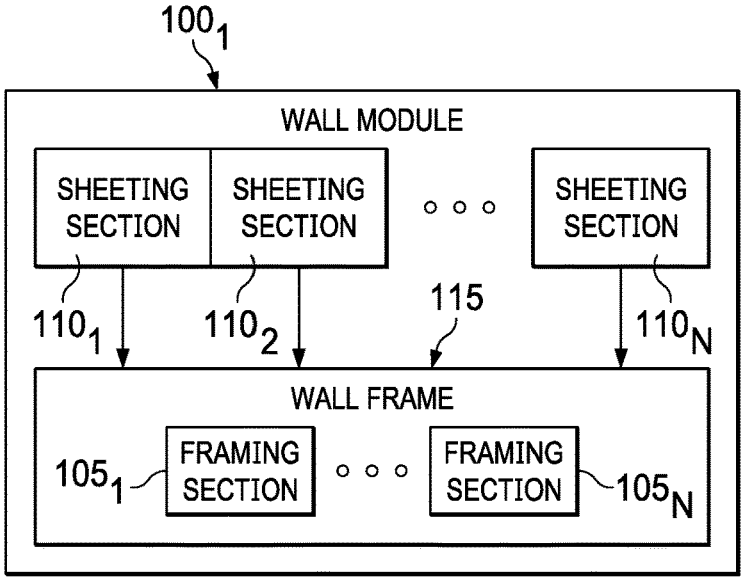
FIG. 1C is a diagrammatic illustration of the wall module of FIG. 1A, according to one or more alternative embodiments.

Referring to FIGS. 1A through 1C, in an embodiment, a wall module is generally referred to by the reference numeral $\mathbf{100}_1$. As shown in FIG. 1A, the wall module $\mathbf{100}_1$ includes framing sections $\mathbf{105}_{1\text{-}3}$ and sheeting sections $\mathbf{110}_{1\text{-}2}$. In some embodiments, the wall module $\mathbf{100}_1$ is or includes structural steel. As shown in FIG. 1A the sheeting sections $\mathbf{110}_{1\text{-}2}$ are attached to the framing sections $\mathbf{105}_{1\text{-}3}$ to form the wall module $\mathbf{100}_1$. More particularly, the framing sections $\mathbf{105}_{1\text{-}3}$ are constructed into an integrated wall frame 115 to which the wall sheeting sections $\mathbf{110}_{1\text{-}2}$ are attached. This construction allows the framing sections $\mathbf{105}_{1\text{-}3}$ to be pre-fabricated off site and then assembled into the wall frame 115 on site and at ground level. The wall module $\mathbf{100}_1$ can then be finished on site by attaching the sheeting sections $\mathbf{110}_{1\text{-}2}$ to the wall frame 115 at ground level, lifting the completed wall module $\mathbf{100}_1$ into place, as will be described in further detail herein, and securing the completed wall module $\mathbf{100}_1$ to a building sub-structure 120, which building sub-structure 120 is part of a building structure 125 such as, for example, a multi-story warehouse structure.

More particularly, as shown in FIG. 1B, in an embodiment, the wall module $\mathbf{100}_1$ and a plurality of additional wall modules $\mathbf{100}_{2\text{-}N}$ are adapted to be aligned with each other and secured to the building sub-structure 120. In some embodiments, the additional wall modules $\mathbf{100}_{2\text{-}N}$ are substantially identical to the wall module $\mathbf{100}_1$ described above in connection with FIG. 1A and, therefore, will not be described in further detail. The building sub-structure 120 to which the wall modules $\mathbf{100}_{1\text{-}N}$ are secured may be or include structural members such as, for example, wall columns, wall girts, wall purlins, wall bracing, the like, or a combination thereof.

Although shown in FIG. 1A and described above as including three framing sections $\mathbf{105}_{1\text{-}3}$, one or more of the wall modules $\mathbf{100}_{1\text{-}N}$ such as, for example, the wall module $\mathbf{100}_1$ shown in FIG. 1C (according to an alternative embodiment), may instead include one, two, four, or more framing sections $\mathbf{105}_{1\text{-}N}$, which framing sections $\mathbf{105}_{1\text{-}N}$ together form the wall frame 115. In addition, or instead, although shown in FIG. 1A and described above as including two sheeting sections $\mathbf{110}_{1\text{-}2}$, one or more of the wall modules $\mathbf{100}_{1\text{-}N}$ such as, for example, the wall module $\mathbf{100}_1$ shown in FIG. 1C (according to an alternative embodiment), may instead include one, three, or more sheeting sections $\mathbf{110}_{1\text{-}N}$ attached to the wall frame 115, as shown in FIG. 1C.

The wall modules $\mathbf{100}_{1\text{-}N}$ of the present disclosure are substituted in place of the steel studs used in conventional wall systems. As a result, the modularized wall system of the present disclosure: is stronger, delivering a better product; can be partially assembled off site; and creates a more rigid platform that allows for modularization of the wall frame 115 and the sheeting sections $\mathbf{110}_{1\text{-}N}$, as described herein. To achieve such modularization, each of the framing sections $\mathbf{105}_{1\text{-}N}$ of the wall frame 115 may be pre-fabricated in a controlled shop environment. For example, as in FIG. 1C, the wall frame 115 may contain multiple separate ones of the framing sections $\mathbf{105}_{1\text{-}N}$ to enable using standard methods of transport to the project site. In some embodiments, the framing sections $\mathbf{105}_{1\text{-}N}$ are or include structural steel. All welding is done in the shop and the framing sections $\mathbf{105}_{1\text{-}N}$ are checked for alignment prior to shipping. Once on site, the separate framing sections $\mathbf{105}_{1\text{-}N}$ are fastened together on a ground level platform (i.e., on the lifting apparatus described herein) to form the wall frame 115. The completed wall frame 115 is then ready for the sheeting sections $\mathbf{110}_{1\text{-}N}$ to be attached thereto before being rigged up and lifted into place for securing to the building structure 125, that is, the building sub-structure 120, as will be described in further detail below.

The construction of the wall frame 115 improves quality control by allowing tolerances, welds, and alignment to be verified in a well-lit, covered shop environment. Further, inspection is made more convenient by allowing the inspector to verify performance of the framing sections $\mathbf{105}_{1\text{-}N}$ and/or the integrated wall frame 115 with an inspection at any point during the construction process (prior to final installation) without requiring special accommodations to access the work (e.g., boom lifts, fall protection, etc.). Further still, as described above, the safety and efficiency of the work constructing the wall frame 115 is improved by minimizing the amount of work performed by personnel at heights requiring fall protection. Further still, the efficiency of equipment use is improved by minimizing the need for crane rigging, hoisting, and boom lift use. Finally, the construction of the wall frame 115 reduces labor costs, and, most significantly, shortens the overall construction schedule.

Additionally, the construction of the wall frame 115 achieves a strong, rigid frame that enables the installation of the sheeting sections $\mathbf{110}_{1\text{-}N}$ at ground level, that is, on the lifting apparatus described herein. In some embodiments, the sheeting sections $\mathbf{110}_{1\text{-}N}$ are insulated metal panels ("IMPs"). Conventionally, the installation of sheeting involves a minimum of an eight (8) man crew, two boom lifts, and a crane. Due to the complexities of working at such a height and the coordination required between all the equipment, the process is slow and laborious. However, with the implementation of the modular wall system described herein, the sheeting sections $\mathbf{110}_{1\text{-}N}$ can be fastened to the assembled wall frame 115 to complete the wall module $\mathbf{100}_1$ before rigging up the completed wall module $\mathbf{100}_1$ and lifting it into place for securing to the building structure 125, that is, the building sub-structure 120, as will be described in further detail below.

The ground level installation of the sheeting sections $\mathbf{110}_{1\text{-}N}$ improves quality control by allowing the completed work to be more closely examined from ground level prior to its being lifted into place. Further, inspection is made more convenient by allowing the inspector to verify performance with an inspection at any point during the constructions process (i.e., prior to final installation) without requiring special accommodations to access the work (e.g., boom lifts, fall protection, etc.). Further still, the safety and efficiency of the work installing the sheeting sections $\mathbf{110}_{1\text{-}N}$ is improved by minimizing the amount of work required to be performed by personnel at heights requiring fall protection. Further still, equipment use is decreased since the work installing the sheeting sections $\mathbf{110}_{1\text{-}N}$ can be performed with minimal crane rigging, hoisting, and boom lift use.

Installing the sheeting sections $\mathbf{110}_{1\text{-}N}$ onto the wall frame 115 at ground level before lifting the completed wall module $\mathbf{100}_1$ into position presents some challenges, including, for example: the need to protect the facade of the sheeting sections $110_{1-N}$ during lifting and installation; the need to protect the sheeting sections $110_{1-N}$ from excessive deflection during lifting; the need to align the completed wall modules $100_{1-N}$ on the building structure 125, that is, the building sub-structure 120; and the need for site conditions permitting use of the modularized wall system of the present disclosure (including a sufficient staging area). The present disclosure addresses these challenges, especially those associated with protecting the sheeting sections $110_{1-N}$ during lifting and installation, by providing a lifting apparatus and method for picking and lifting the wall modules $100_{1-N}$ into position.

Figures 1, 2A:
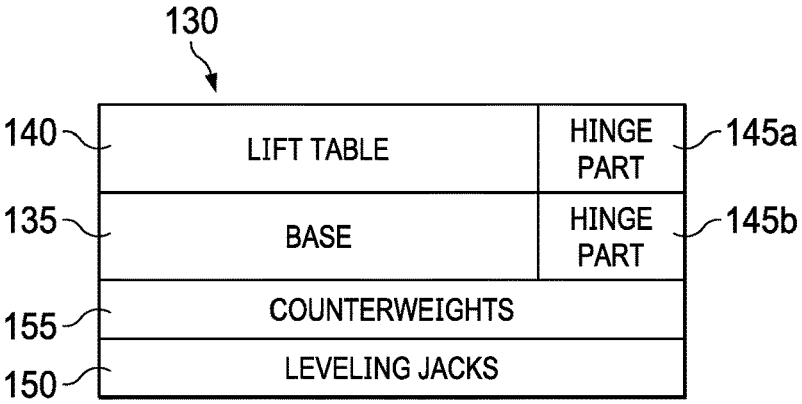
FIG. 2A-1 is a diagrammatic illustration of a lifting apparatus in a first operational state or configuration, according to one or more embodiments.
Figures 2, 2A:
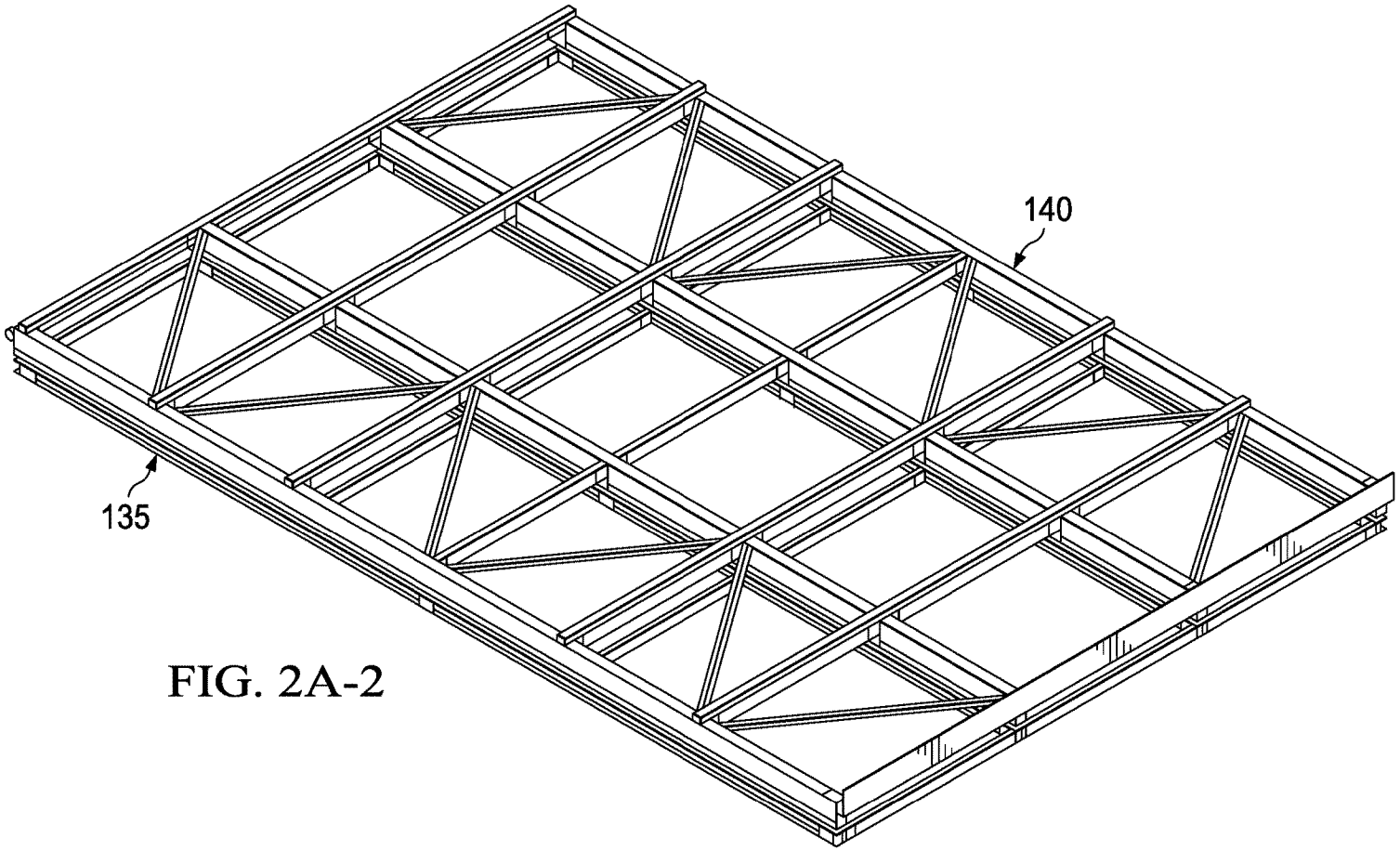
Figures 2, 2A, 3:
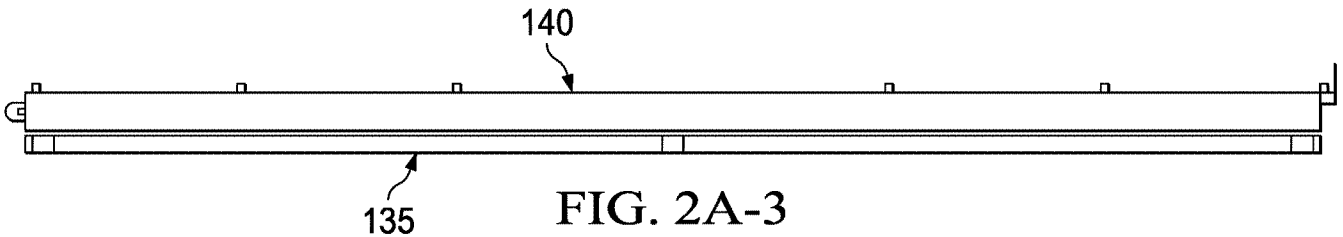

FIG. 2A-1 is a diagrammatic illustration of such a lifting apparatus, generally referred to by the reference numeral 130, in a first operational state or configuration (i.e., a "loading" configuration), according to one or more embodiments. Referring to FIG. 2A-1, in an embodiment, the lifting apparatus 130 includes a base 135 and a lift table 140. In some embodiments, in the first configuration, the lift table 140 and the base 135 are spaced in a parallel relation. The lift table 140 includes a hinge part 145*a*. The base 135 includes a hinge part 145*b*. The lift table 140 is hingedly connected to the base 135 via the hinge parts 145*a-b*. The lift table 140 is adapted to accommodate successive ones of the wall modules $100_{1-N}$ described above in connection with FIGS. 1A and 1B. Additionally, the lifting apparatus 130 is constructed so that it can be leveled on site. More particularly, the lifting apparatus 130 includes a plurality of leveling jacks 150 secured to the base 135 and adapted to level the lifting apparatus 130 for each setup. The lifting apparatus 130 further includes a plurality of counterweights 155, which counterweights 155 are attached to the base 135 to hold the base 135 in position on site when the lifting apparatus 130 is actuated from the first configuration, as shown in FIG. 2A-1, to a second configuration, as will be shown and described below in connection with FIGS. 2B-1 through 2B-4. FIGS. 2A-2 and 2A-3 are perspective and elevational views, respectively, of the lift table 140 and the base 135 of FIG. 2A-1 in the first operational state or configuration, according to one or more embodiments. In some embodiments, as in FIGS. 2A-2 and 2A-3, the lifting apparatus 130 is constructed with bolted connections to allow for quick and easy disassembly and reassembly on the project site. Moreover, the lifting apparatus 130 is designed to allow it to be lifted with a crane once positioned on site. For example, a crawler crane may be used on site to position and subsequently re-position the lifting apparatus 130 for installation of successive ones of the wall modules $100_{1-N}$, thus providing the option to pick and carry the lifting apparatus 130 to another location quickly and efficiently.

Figures 1, 2B:
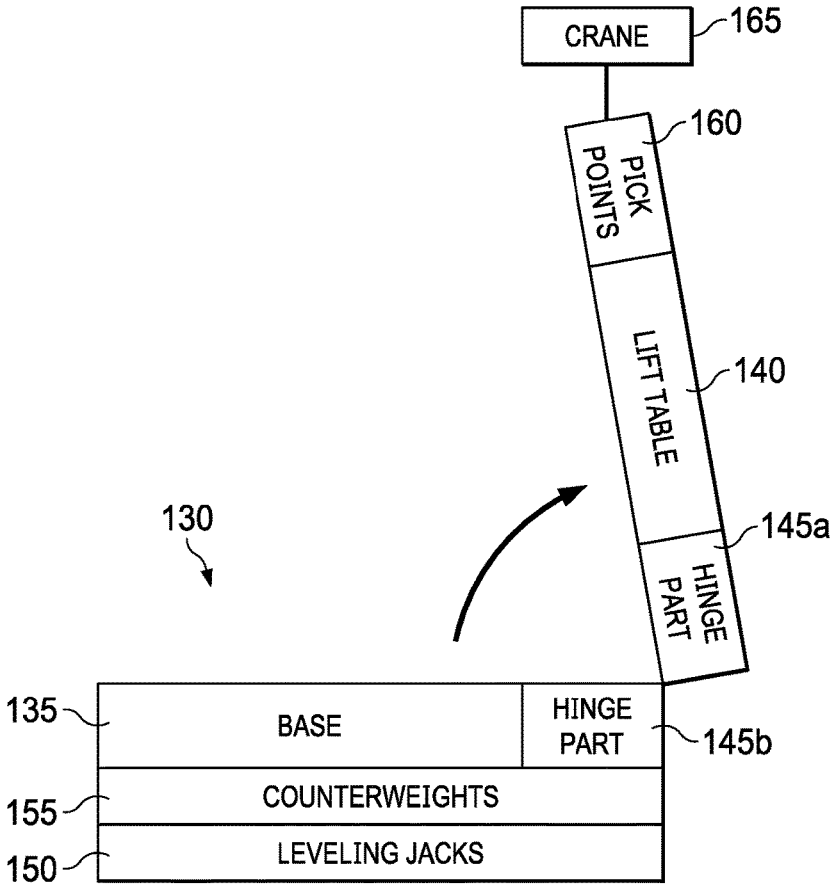
Figures 2, 2B:
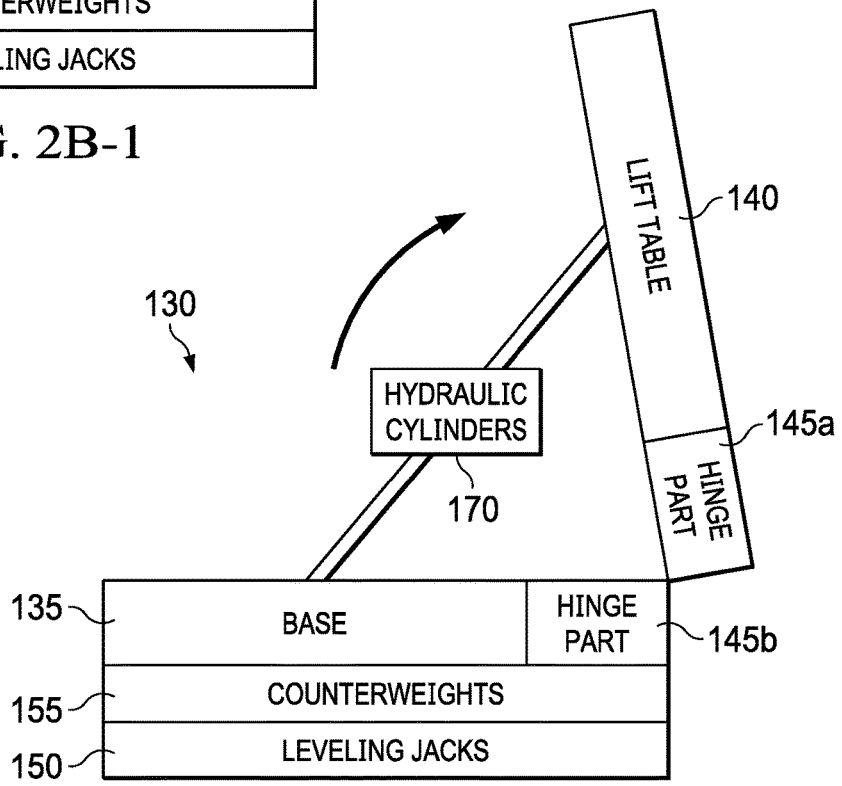
Figures 2, 2B, 3:
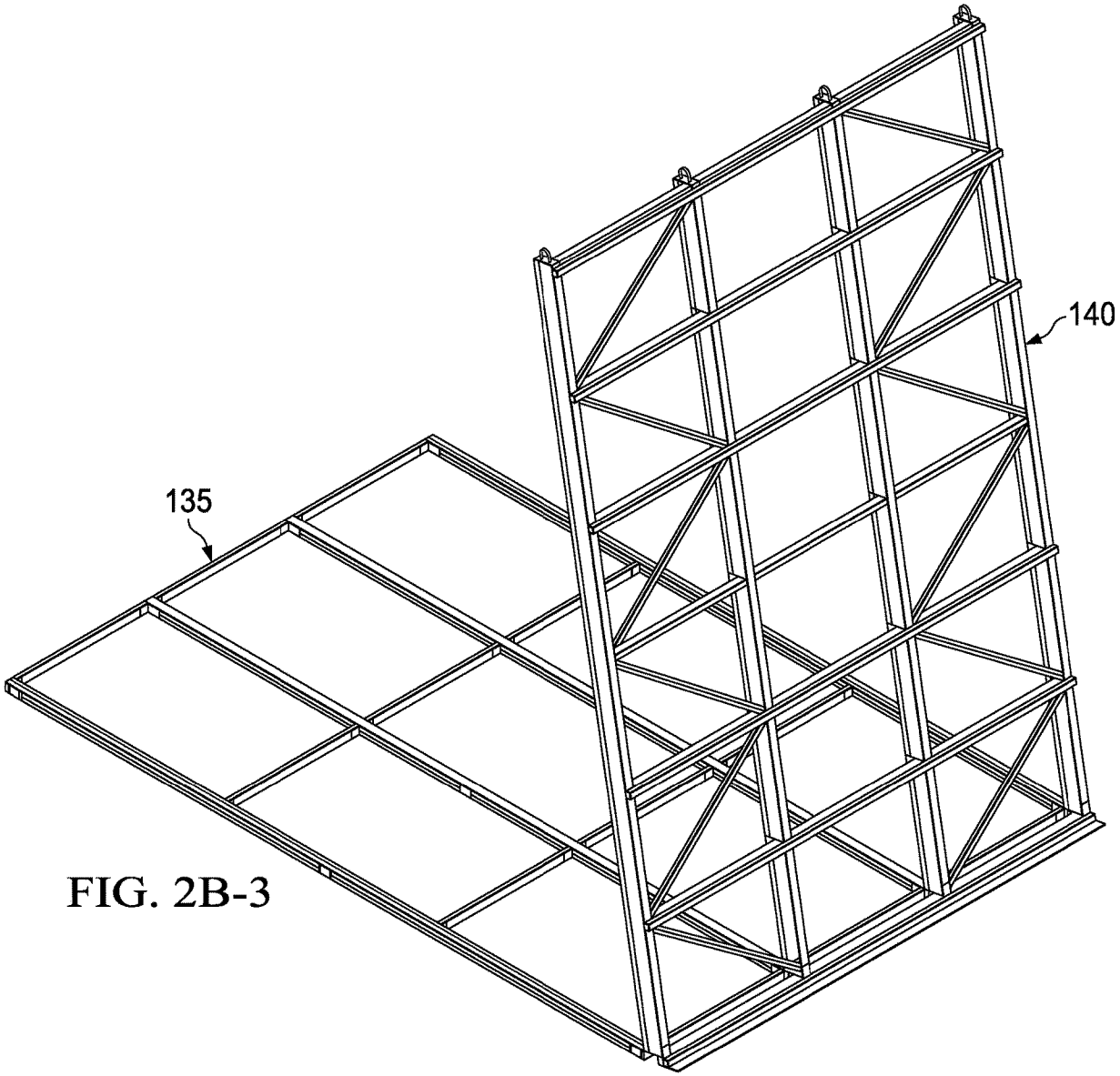
Figures 2, 2B, 3, 4:
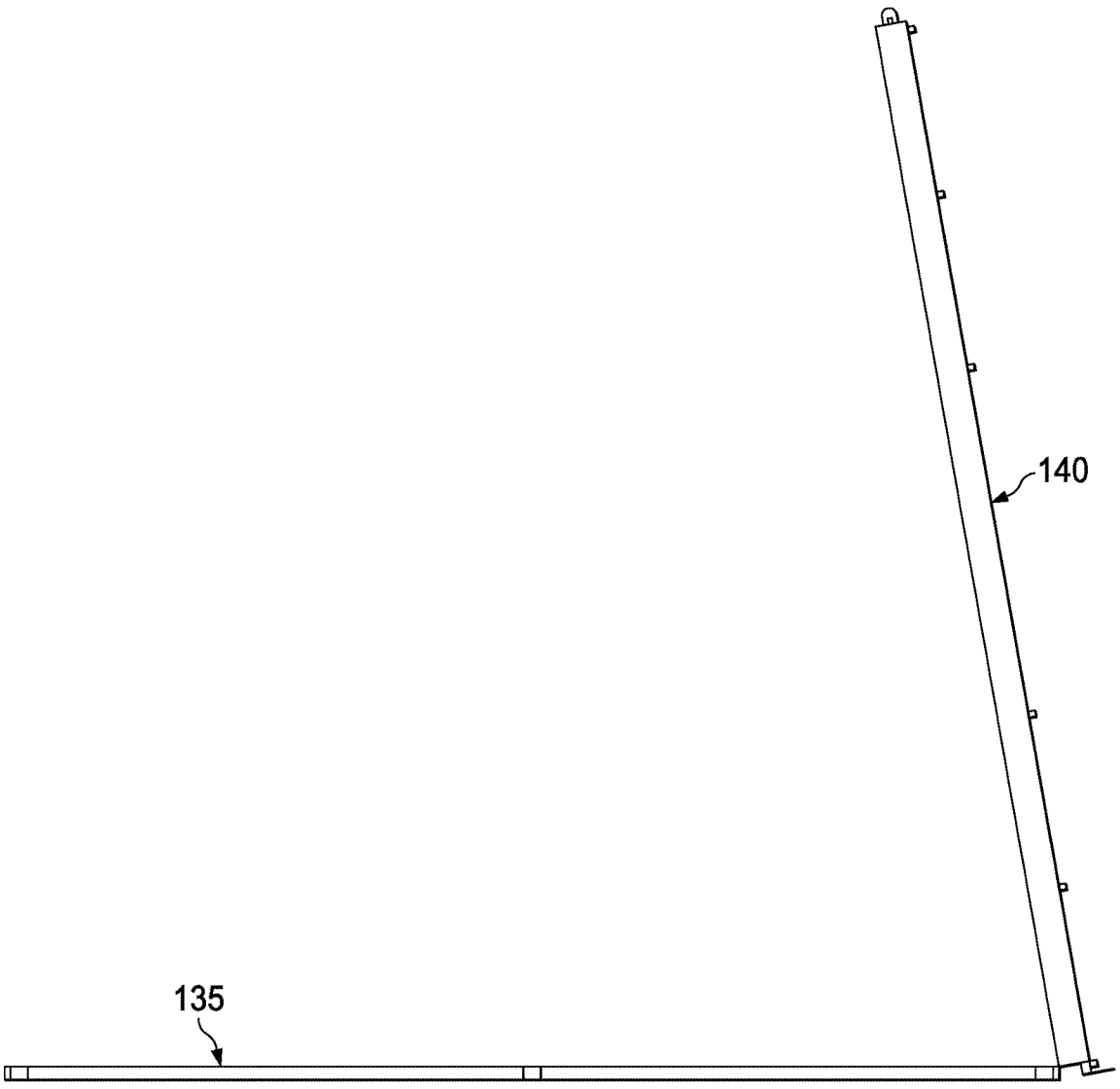

FIGS. 2B-1 and 2B-2 are diagrammatic illustrations of the lifting apparatus 130 of FIG. 2A-1 in a second operational state or configuration (i.e., an "unloading" configuration), according to one or more embodiments. In some embodiments, in the second configuration, the lift table 140 is spaced at an 80-degree angle from the base 135. Alternatively, the lift table 140 may be spaced at another angle from the base 135 in the second configuration, such as, for example, an angle in the range of 79 to 81-degrees, an angle in the range of 75 to 85-degrees, an angle in the range of 70 to 90-degrees, an angle of greater than 79 degrees, an angle of greater than 75 degrees, an angle of greater than 70 degrees, an angle of greater than 65 degrees, an angle of greater than 60 degrees, an angle of greater than 55 degrees, an angle of greater than 50 degrees, an angle of greater than 45 degrees, or another angle. Referring to FIG. 2B-1, in an embodiment, the lift table 140 includes pick points 160. The pick points 160 are adapted to be rigged to a crane 165 to enable the crane 165 to actuate the lifting apparatus 130 from the first configuration to the second configuration. More particularly, the pick points 160 are positioned opposite the hinge part 145*a* so that, when the crane 165 is rigged to the pick points 160 and hoists the lift table 140, the lift table 140 pivots about the hinge points 145*a-b* into the second configuration. Referring to FIG. 2B-2, in an alternative embodiment, the pick points 160 are omitted in favor of one or more hydraulic cylinders 170 connected between the base 135 and the lift table 140 to actuate the lifting apparatus 130 from the first configuration to the second configuration. FIGS. 2B-3 and 2B-4 are perspective and elevational views, respectively, of the lift table 140 and the base 135 of FIGS. 2B-1 and 2B-2 in the second operational state or configuration, according to one or more embodiments.

Figure 3A:
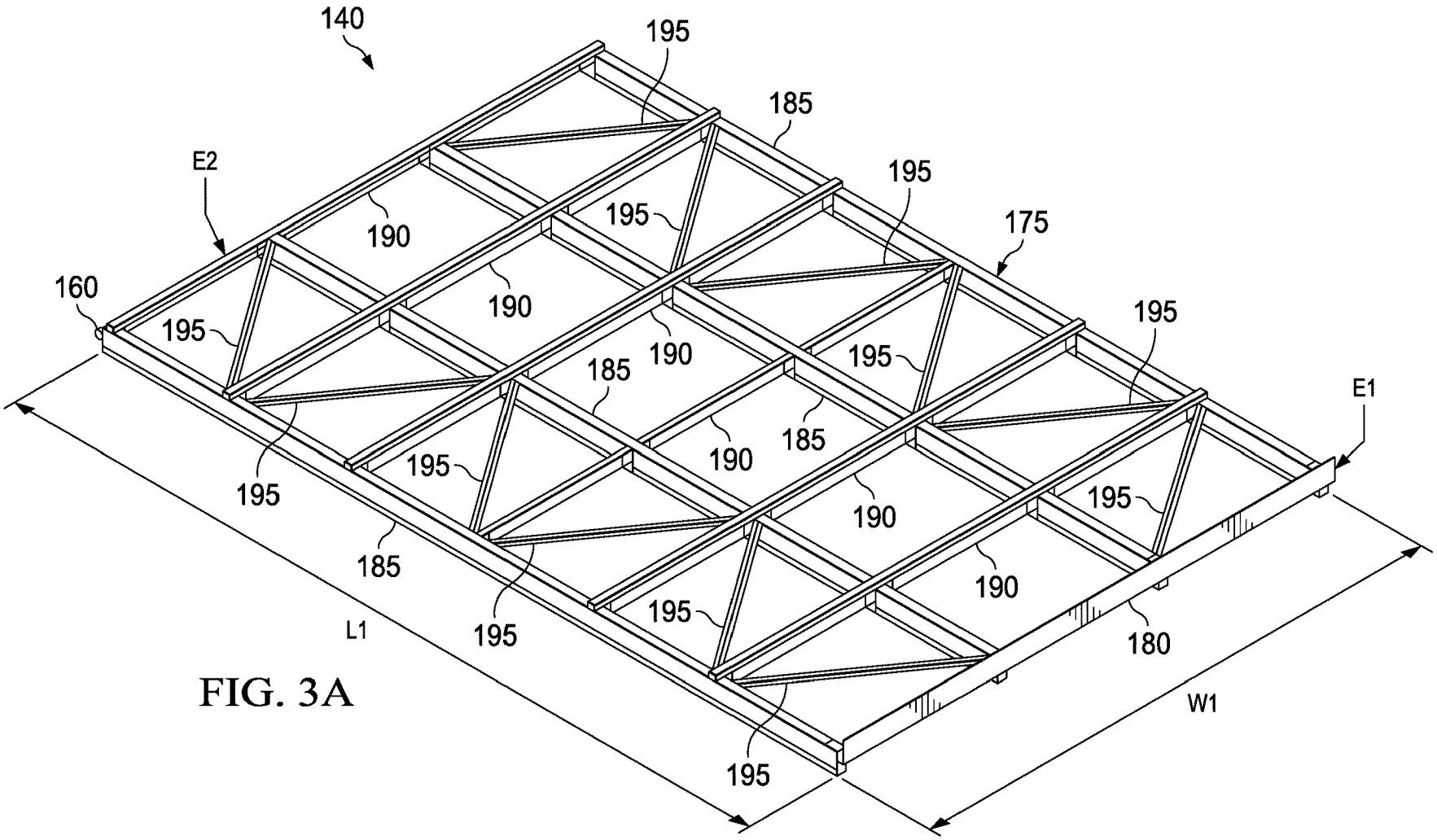
FIG. 3A is a perspective view of a lift table of the lifting apparatus of FIGS. 2A-1 through 2B-4, according to one or more embodiments.
Figure 3B:
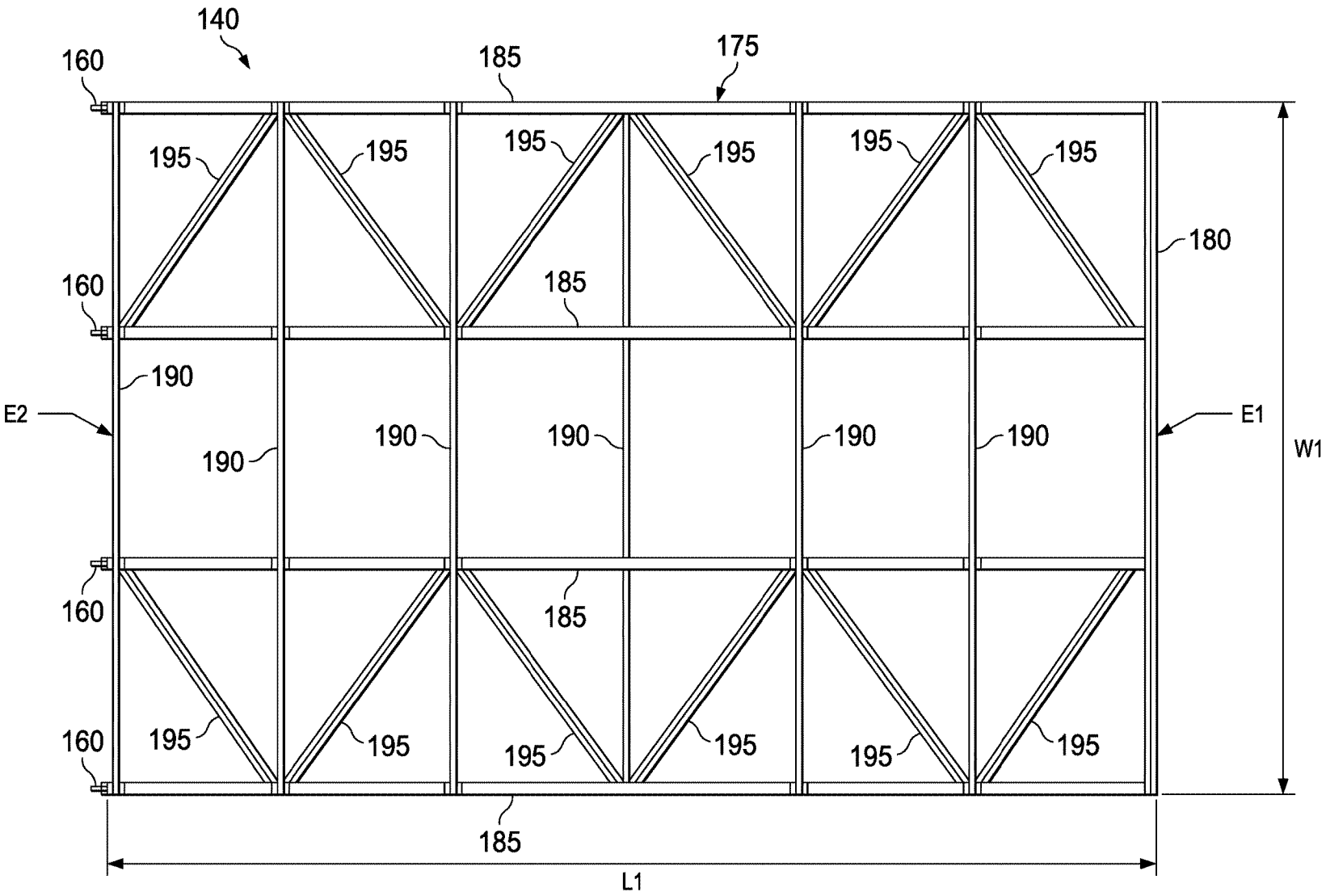
FIG. 3B is a top plan view of the lift table of the lifting apparatus of FIGS. 2A-1 through 2B-4, according to one or more embodiments.
Figure 3C:
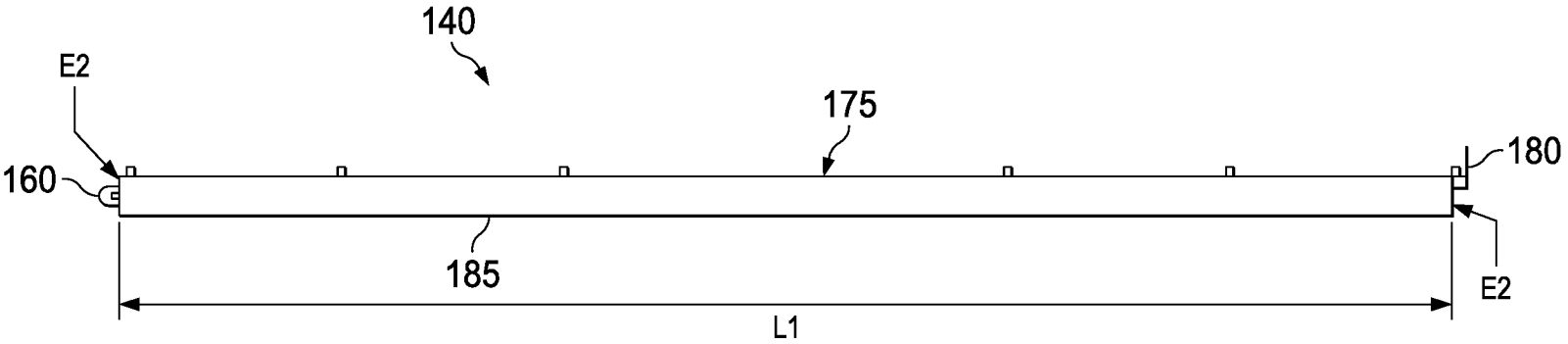
FIG. 3C is an elevational view of the lift table of the lifting apparatus of FIGS. 2A-1 through 2B-4, according to one or more embodiments.

FIGS. 3A through 3C are perspective, top plan, and elevational views, respectively, of the lift table 140 of FIGS. 2A-1 through 2B-4, according to one or more embodiments. In some embodiments, the lift table 140 is or includes structural steel. Referring to FIGS. 3A through 3C, in an embodiment, the lift table 140 includes a lifting frame 175, a nose plate 180, and the pick points 160. The lifting frame 175 is rectangular in shape. The lifting frame 175 includes a plurality of interconnected structural members, such as, for example, interconnected beams, braces, angles, and brackets. More particularly, as shown in FIGS. 3A through 3B, the lifting frame 175 includes lengthwise beams 185 spaced apart in a parallel relation. Although described as including the four (4) lengthwise beams 185, the lifting frame 175 may instead include two (2), three (3), five (5) or more lengthwise structural beams spaced apart in a parallel relation. Further, the lifting frame 175 includes widthwise beams 190 interconnecting the lengthwise beams 185 such that the lifting frame 175 forms the rectangular shape. Further still, the lifting frame 175 includes braces 195 extending in alternating diagonal directions between respective outer pairs of the lengthwise beams 185. The braces 195 provide extra structural support to prevent, or at least reduce, deflection of the lifting frame 175 when successive ones of the wall modules $100_{1-N}$ are supported on the lift table 140. In some embodiments, the lifting frame 175 has a widthwise dimension W1 of about 40 feet and a lengthwise dimension L1 of about 60 feet. The nose plate 180 extends (e.g., perpendicularly) along a widthwise edge E1 of the lifting frame 175 and is adapted to support successive ones of the wall modules $100_{1-N}$ when the lifting apparatus 130 is in the second configuration, as will be described in further detail below. The pick points 160 are positioned at an opposite widthwise edge E2 of the lifting frame 175. An Appendix forms part of the '268 Application, which is hereby incorporated herein by reference in its entirety; pages 2 through 41 of the Appendix of the '268 Application illustrate detailed build plans for the lift table 140 shown in FIGS. 3A through 3C of the drawings.

Figure 4A:
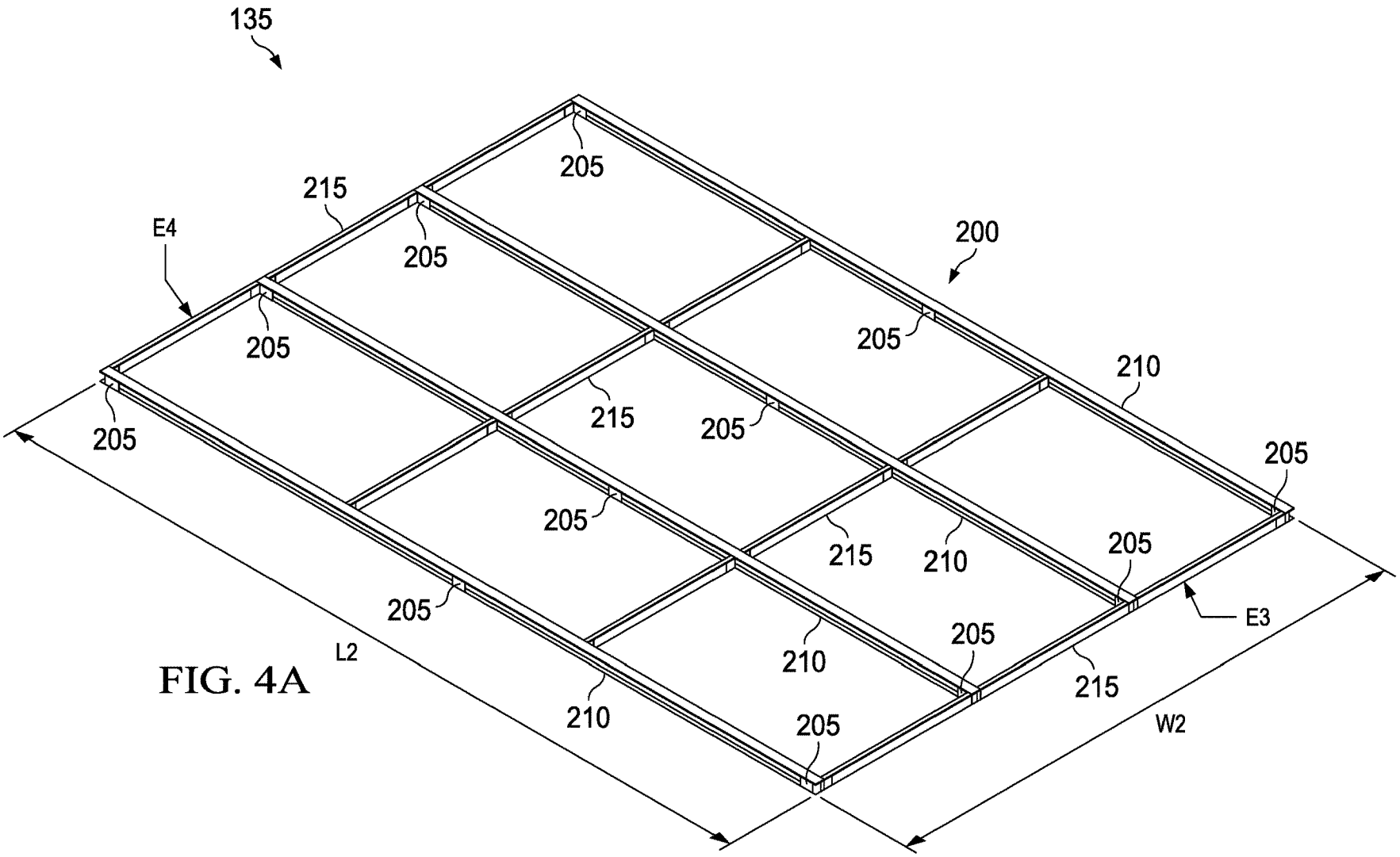
FIG. 4A is a perspective view of a base of the lifting apparatus of FIGS. 2A-1 through 2B-4, according to one or more embodiments.
Figure 4B:
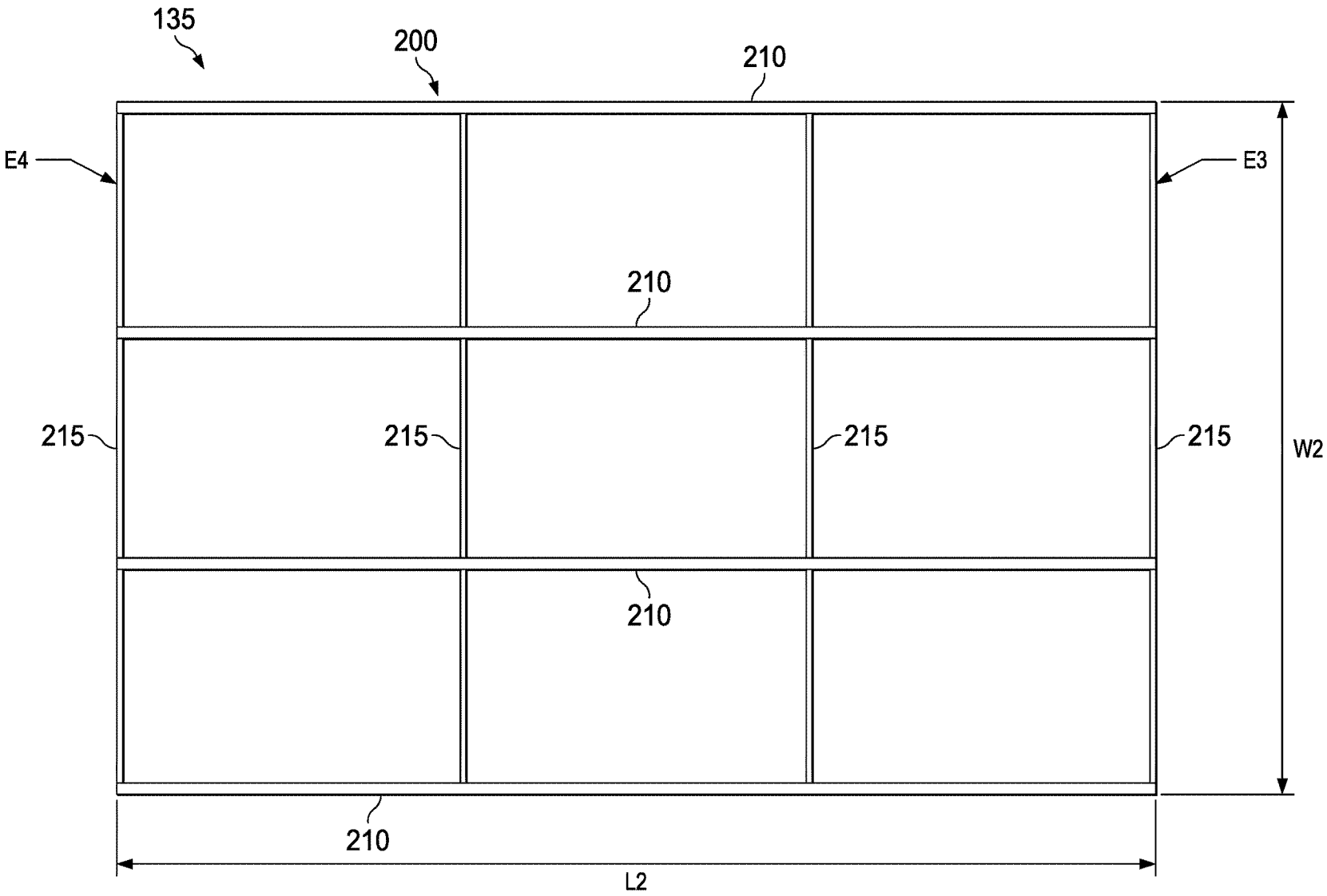
FIG. 4B is a top plan view of the base of the lifting apparatus of FIGS. 2A-1 through 2B-4, according to one or more embodiments.
Figure 4C:
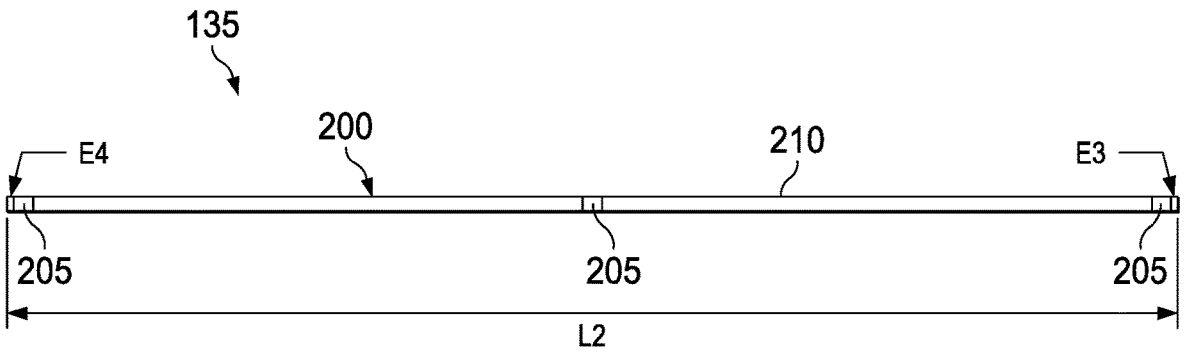
FIG. 4C is an elevational view of the base of the lifting apparatus of FIGS. 2A-1 through 2B-4, according to one or more embodiments.

FIGS. 4A through 4C are perspective, top plan, and elevational views, respectively, of the base 135 of FIGS. 2A-1 through 2B-4, according to one or more embodiments. In some embodiments, the base 135 is or includes structural steel. Referring the FIGS. 4A through 4C, in an embodiment, the base 135 includes a base frame 200 and lifting point stiffener plates 205. The base frame 200 is rectangular in shape. The base frame 200 includes a plurality of interconnected structural members, such as, for example, interconnected beams and brackets. More particularly, as shown in FIGS. 4A through 4B, the base frame 200 includes lengthwise beams 210 spaced apart in a parallel relation. Although described as including the four (4) lengthwise beams 210, the base frame 200 may instead include two (2), three (3), five (5) or more lengthwise structural beams spaced apart in a parallel relation. Further, the base frame 200 includes widthwise beams 215 interconnecting the lengthwise beams 210 such that the base frame 200 forms the rectangular shape. In some embodiments, the base frame 200 has a widthwise dimension W2 of about 40 feet and a lengthwise dimension L2 of about 60 feet. In some embodiments, as in FIGS. 4A through 4C, the lifting point stiffener plates 205 are attached to the lengthwise beams 210 of the base frame 200. For example, the lifting point stiffener plates 205 may be attached to the lifting frame 175 in a grid of twelve (12) different locations. For another example, the lifting point stiffener plates 205 may be attached to the lifting frame 175 in a grid of nine (9) different locations. For yet another example, the lifting point stiffener plates 205 may be attached to the lifting frame 175 in a grid of at least five (5) different locations. Pages 42 through 54 of the Appendix of the '268 Application illustrate detailed build plans for the base 135 shown in FIGS. 4A through 4C of the drawings.

Each location at which the lifting point stiffener plates 205 are attached to the lifting frame 175 corresponds one of the leveling jacks 150 (shown in FIGS. 2A-1, 2B-1, and 2B-2), which leveling jacks 150 are adapted to be connected to the lifting point stiffener plates 205 to level the base 135 on site. Further, in some embodiments, the counterweights 155 (shown in FIGS. 2A-1, 2B-1, and 2B-2) include two (2) counterweights 155. In some instances, the first counterweight 155 is adapted to be hung from one or more of the lifting point stiffener plates 205 positioned along a widthwise edge E3 of the base frame 200. Moreover, the second counterweight 155 is adapted to be hung from one or more of the lifting point stiffener plates 205 positioned along an opposite widthwise edge E4 of the base frame 200. Detailed build plans for the counterweights 155 are illustrated on pages 62 through 65 of the Appendix of the '268 Application. Finally, in some embodiments, one or more of the lifting point stiffener plates 205, such as the lifting point stiffener plates 205 positioned along the widthwise edge E3 of the base frame 200, may serve as the hinge part 145*b* (shown in FIGS. 2A-1, 2B-1, and 2B-2) of the base 135.

Figure 5:
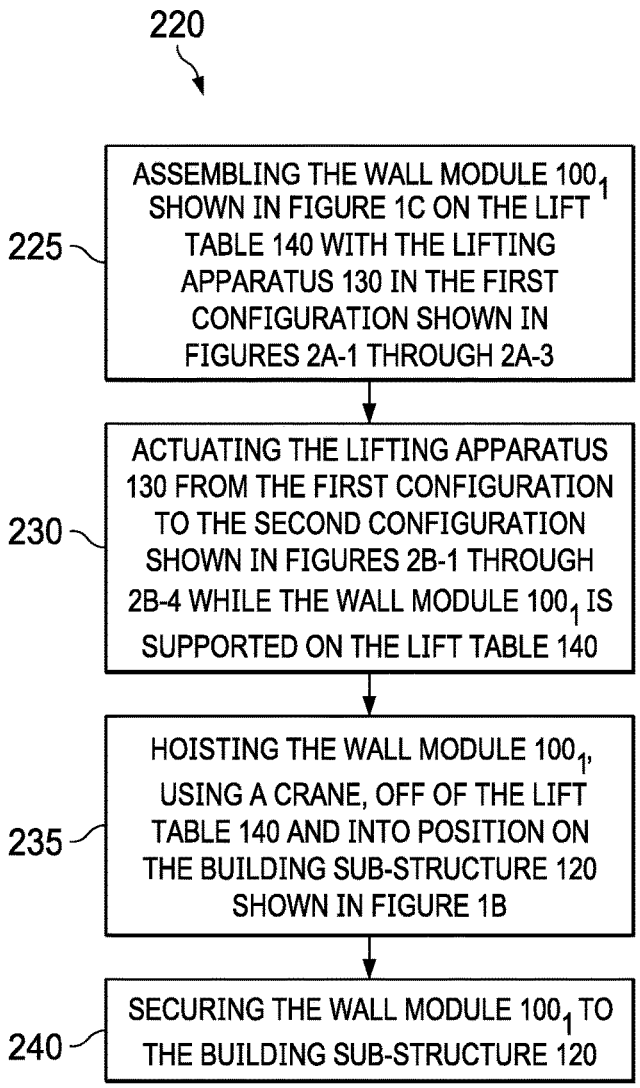
FIG. 5 is a flow diagram of a method for implementing one or more embodiments of the present disclosure.
Figure 6A:
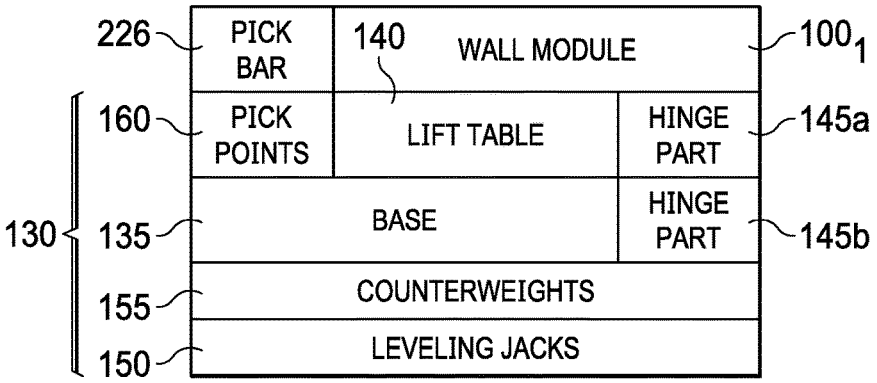
FIG. 6A is a diagrammatic illustration of a system including the lifting apparatus of FIGS. 2A-1 through 2B-4, the system being in a third operational state or configuration during the execution of FIG. 5's method, according to one or more embodiments.

Referring to FIG. 5, a method 220 of installing the wall module $\mathbf{100}_1$ on the building structure 125, that is, the building sub-structure 120, is illustrated according to one or more embodiments. The method 220 includes at a step 225, assembling the wall module $\mathbf{100}_1$ shown in FIG. 1C on the lift table 140 with the lifting apparatus 130 in the first configuration shown in FIGS. 2A-1 through 2A-3. FIG. 6A diagrammatically illustrates the wall module $\mathbf{100}_1$ assembled on the lift table 140 with a pick bar 226 attached to the wall module $\mathbf{100}_1$. Pages 55-58 of the Appendix of the '268 Application illustrate detailed build plans for the pick bar 226. In one or more embodiments, to assemble the wall module $\mathbf{100}_1$ on the lift table 140 at the step 225, the framing sections $\mathbf{105}_{1\text{-}N}$ shown in FIG. 1C are pre-assembled offsite. The framing sections $\mathbf{105}_{1\text{-}N}$ are then interconnected on site to form the wall frame 115 supported on the lift table 140. Finally, the sheeting sections $\mathbf{110}_{1\text{-}N}$ are secured to the wall frame 115 supported on the lift table 140 to complete the wall module $\mathbf{100}_1$.

Figure 6B:
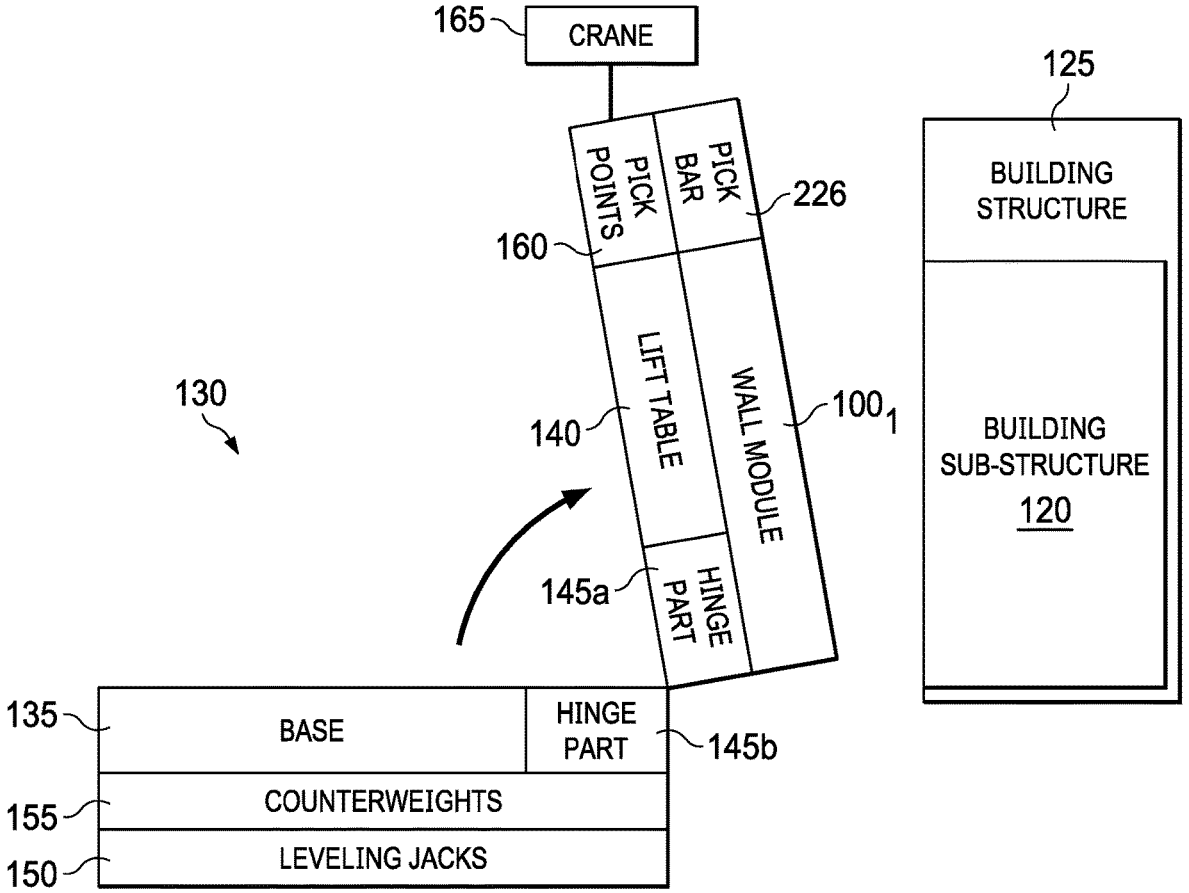
FIG. 6B is a diagrammatic illustration of the system including the lifting apparatus of FIGS. 2A-1 through 2B-4, the system being in a fourth operational state or configuration during the execution of FIG. 5's method, according to one or more embodiments.

At a step 230 of the method 220 shown in FIG. 5, the lifting apparatus 130 is actuated from the first configuration to the second configuration shown in FIGS. 2B-1 through 2B-4 while the wall module $\mathbf{100}_1$ is supported on the lift table 140. FIG. 6B diagrammatically illustrates the crane 165 rigged to the pick points 160 of the lift table 140 to actuate the lifting apparatus 130 from the first configuration to the second configuration, as also shown in FIG. 2B-1. Alternatively, the pick points 160 may be omitted from the lift table 140 in favor of the hydraulic cylinders 170 connected between the lift table 140 and the base 135 to actuate the lifting apparatus 130 from the first configuration to the second configuration, as shown in FIG. 2B-2. At the step 230, the wall module $\mathbf{100}_1$ pivots together with the lift table 140 about the hinge parts 145*a-b* to the second configuration. During this pivoting, the counterweights 155 hold the base 135 and the leveling jacks 150 in position.

Figure 6C:
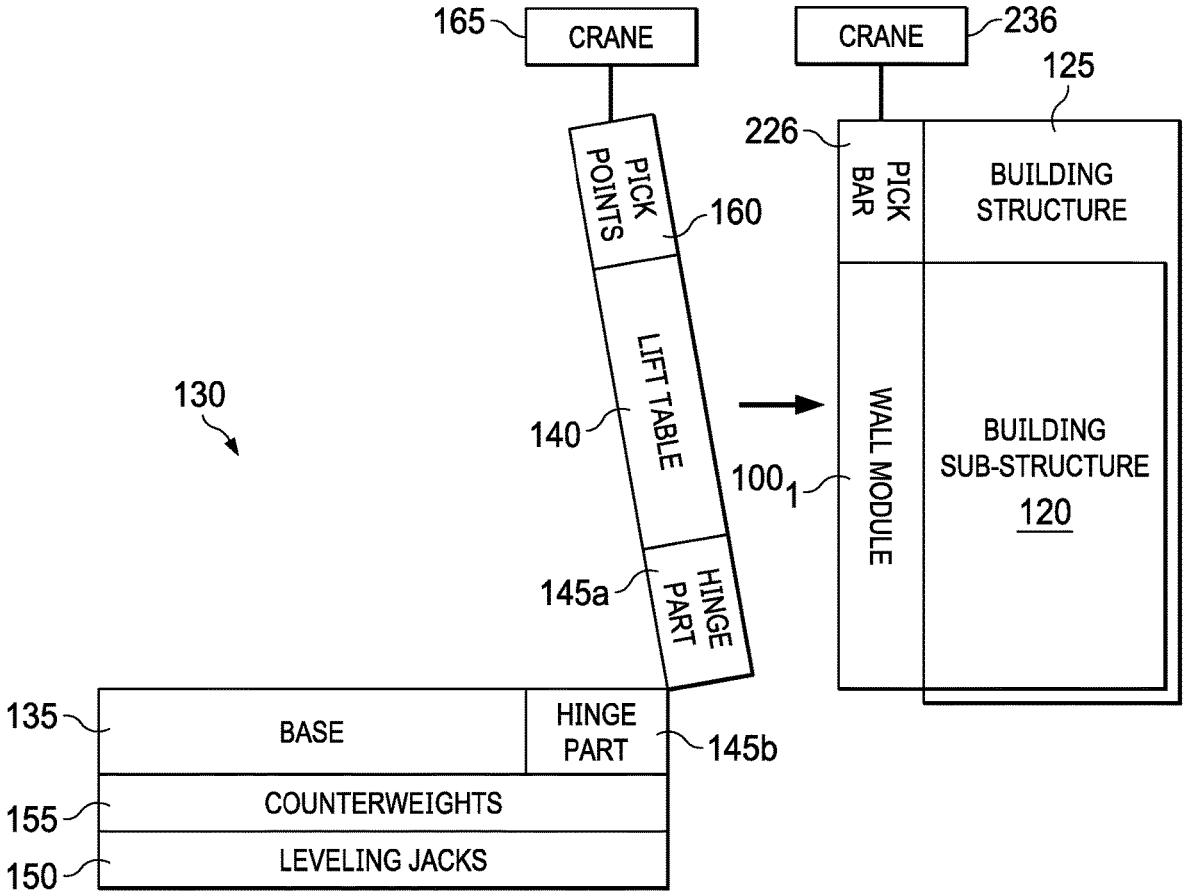
FIG. 6C is a diagrammatic illustration of the system including the lifting apparatus of FIGS. 2A-1 through 2B-4, the system being in a fifth operational state or configuration during the execution of FIG. 5's method, according to one or more embodiments.

At a step 235 of the method 220 shown in FIG. 5, while the lifting apparatus 130 is in the second configuration, the wall module $\mathbf{100}_1$ is hoisted, using a crane 236, off of the lift table 140 and into position on the building sub-structure 120 shown in FIG. 1B. FIG. 6C illustrates the crane 236 hoisting the wall module $\mathbf{100}_1$ into position on the building sub-structure 120 via the pick bar 226 connected to the wall module $\mathbf{100}_1$. Page 61 of the Appendix of the '268 Application illustrates the rigging scheme by which the crane 236 hoists the wall module $\mathbf{100}_1$. In those embodiments in which the crane 165 is used at the step 230 to actuate the lifting apparatus 130 from the first configuration to the second configuration, a different crane, such as the crane 236, may be used to hoist the wall module $\mathbf{100}_1$ off of the lift table 140 and into position on the building sub-structure 120. Alternatively, the lifting apparatus 130 may be locked in the second configuration using a locking mechanism (not shown) and the crane 165 may be re-rigged to the wall module $\mathbf{100}_1$ to hoist the wall module $\mathbf{100}_1$ into position on the building sub-structure 120.

Finally, at a step 240 of the method 220 shown in FIG. 5, the wall module $\mathbf{100}_1$ is secured to the building sub-structure 120. Page 67 of the Appendix of the '268 Application describes and illustrates the manner in which the wall module $\mathbf{100}_1$ is secured to the building sub-structure 120.

Figure 6D:
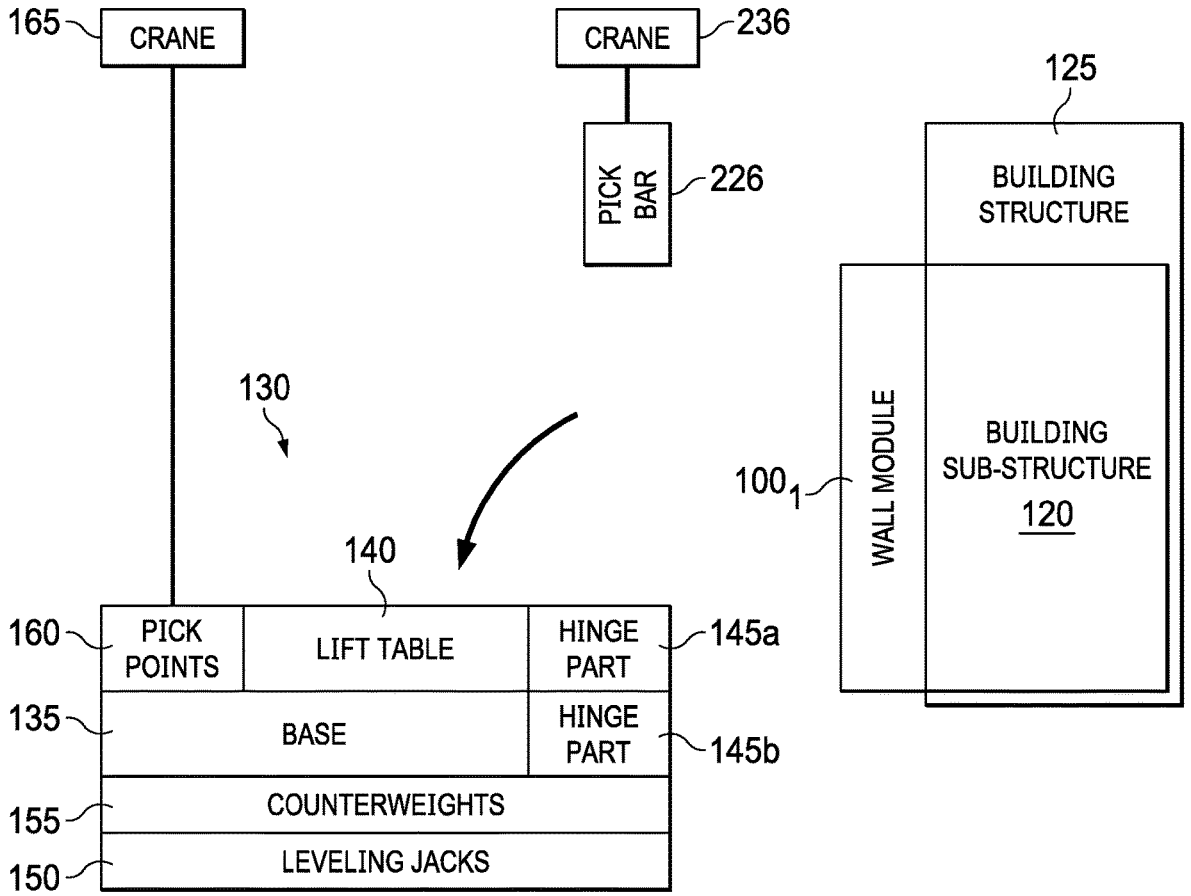
FIG. 6D is a diagrammatic illustration of the system including the lifting apparatus of FIGS. 2A-1 through 2B-4, the system being in a sixth operational state or configuration during the execution of FIG. 5's method, according to one or more embodiments.

Referring to FIG. 6D, after the method 220 has been completed, the pick bar 226 is detached from the wall module $\mathbf{100}_1$ in preparation for installing a next one of the wall modules $\mathbf{100}_{2\text{-}N}$ using the pick bar 226. Moreover, the lift table 140 is lowered back into the first configuration so that the next one of the wall modules $\mathbf{100}_{2\text{-}N}$ may be loaded onto the lift table 140 for installation onto the building sub-structure 120. The manner in which the wall modules $\mathbf{100}_{2\text{-}N}$ are installed onto the building sub-structure 120 is substantially identical to the manner in which the wall module $\mathbf{100}_1$ is installed onto the building sub-structure 120 using the method 220 and, therefore, will not be described in further detail. In some instances, before the next one of the wall modules $\mathbf{100}_{2\text{-}N}$ can be installed onto the building sub-structure 120, the lifting apparatus 130 must be moved to a different position relative to the building structure 125. Pages 59 and 60 of the Appendix of the '268 Application illustrate the rigging scheme by which the crawler crane hoists the lifting apparatus 130 to move the lifting apparatus 130 to a different on-site location. In some embodiments, the counterweights 155 are moved separately from the remainder of the lifting apparatus 130 to the new on-site location. For example, page 66 of the Appendix of the '268 Application illustrates the rigging scheme by which the crawler crane separately hoists each of the counterweights 155 of the lifting apparatus 130 to move the counterweights 155 to the different on-site location.

The lifting apparatus 130 and the method 220 described herein provide a safe, ground-level working platform on which to assemble each wall frame 115, install the sheeting sections $\mathbf{110}_{1\text{-}N}$, and then to transition the completed wall module $\mathbf{100}_1$ from a horizontal orientation to a vertical orientation (e.g., an 80-degree vertical position). Conventionally, to transition a wall section from a horizontal position to a vertical position, rolling blocks have been used to lift the wall section from four (4) points. However, this required attachment points on the face of the wall section, which attachment points would be incompatible with the present wall modules $\mathbf{100}_{1\text{-}N}$. Additionally, the process of lifting and rotating such a wall section to vertical created a bending moment in the structural elements of the wall section, causing a deflection greater than what the connections attaching sheeting to the wall section could tolerate. Both of these challenges are addressed by the lifting apparatus 130 and the method 220 of the present disclosure. More particularly, the lifting apparatus 130 and the method 220 of the present disclosure minimize stresses within each wall module $\mathbf{100}_{1\text{-}N}$ by, for example, limiting the maximum deflection of each wall module $\mathbf{100}_{1\text{-}N}$ to one inch or less. Further, the efficiency of crane rigging is improved by the lifting apparatus 130 and the method 220 of the present disclosure because the wall module $\mathbf{100}_{1\text{-}N}$ are rigged for vertical lifting via the pick bar 226 only once at ground level. Further still, the lifting apparatus 130 and method 220 of the present disclosure protect the facade of the sheeting sections $\mathbf{110}_{1\text{-}N}$ because no rigging is required on or across the face of the wall module $\mathbf{100}_1$. Further still, the lifting apparatus 130 and the method 220 of the present disclosure provide a level working platform (i.e., the lift table 140) at a safe height not requiring fall protection. Finally, the lifting apparatus 130 and the method 220 of the present disclosure accommodate the ground-level construction of the wall modules $\mathbf{100}_{1\text{-}N}$, as previously discussed herein.

In some embodiments, one or more of the embodiments of the present application are provided in whole or in part as described and illustrated in the Appendix of the '268 Application, which forms part of the present application.

In some embodiments, one or more of the embodiments described and illustrated in the Appendix of the '268 Application are combined in whole or in part with one or more of the embodiments described above and/or one or more of the other embodiments described and illustrated in the Appendix.

A method has been disclosed. The method generally includes: actuating, while a wall module is supported on a lift table of a lifting apparatus, the lifting apparatus from a first configuration to a second configuration, wherein the lift table is pivotably connected to a base of the lifting apparatus, and wherein, in the second configuration of the lifting apparatus, the lift table is spaced at a first angle from the base; and hoisting, while the lifting apparatus is in the second configuration, the wall module off of the lift table. In one or more embodiments, the method further includes; assembling, while the lifting apparatus is in the first configuration and before actuating the lifting apparatus from the first configuration to the second configuration, the wall module on the lift table, wherein, in the first configuration of the lifting apparatus, the lift table: extends in a direction that is parallel to a direction of extension of the base; or is spaced at a second angle from the base, the second angle being smaller than the first angle. In one or more embodiments, assembling the wall module on the lift table includes attaching sheeting sections to a wall frame to form the wall module on the lift table. In one or more embodiments, the method further includes, after hoisting the wall module off of the lift table: positioning the wall module on a building structure; and securing the wall module into position on the building structure. In one or more embodiments, in the second configuration of the lifting apparatus, the first angle by which the lift table is spaced from the base is greater than 45 degrees. In one or more embodiments, one or more pick points are attached to the lift table; and actuating the lifting apparatus from the first configuration to the second configuration includes: rigging a crane to the pick point(s); and lifting the lift table, via the pick point(s) and using the crane. In one or more embodiments, a pick bar is attached to the wall module; and hoisting the wall module off of the lift table includes: rigging a crane to the pick bar; and lifting the wall module, via the pick bar and using the crane. In one or more embodiments, the lifting apparatus includes one or more hydraulic cylinders connected between the base and the lift table; and the lifting apparatus is actuated from the first configuration to the second configuration using the hydraulic cylinder(s).

A system has also been disclosed. The system generally includes: a wall module adapted to be supported on a lift table of a lifting apparatus; the lifting apparatus, which lifting apparatus is actuable, while the wall module is supported on the lift table, from a first configuration to a second configuration, wherein the lift table is pivotably connected to a base of the lifting apparatus, and wherein, in the second configuration of the lifting apparatus, the lift table is spaced at a first angle from the base; and a first crane adapted to hoist, while the lifting apparatus is in the second configuration, the wall module off of the lift table. In one or more embodiments, in the first configuration of the lifting apparatus, the lift table: extends in a direction that is parallel to a direction of extension of the base; or is spaced at a second angle from the base, the second angle being smaller than the first angle. In one or more embodiments, the wall module includes sheeting sections and a wall frame to which the sheeting sections are attached. In one or more embodiments, the system further includes a building structure to which the wall module is adapted to be secured. In one or more embodiments, in the second configuration of the lifting apparatus, the first angle by which the lift table is spaced from the base is greater than 45 degrees. In one or more embodiments, one or more pick points are attached to the lift table; and the system further includes a second crane rigged to the pick point(s) to actuate the lifting apparatus from the first configuration to the second configuration. In one or more embodiments, the second crane is different from the first crane. In one or more embodiments, a pick bar is attached to the wall module; and the first crane is rigged to the pick bar to hoist the wall module off of the lift table. In one or more embodiments, the lifting apparatus includes one or more hydraulic cylinders connected between the base and the lift table to actuate the lifting apparatus from the first configuration to the second configuration.

A lifting apparatus has also been disclosed. The lifting apparatus generally includes: a base; and a lift table pivotably connected to the base, the lift table being adapted to support a wall module, wherein the lifting apparatus is actuable, while the wall module is supported on the lift table, from a first configuration to a second configuration, wherein, in the second configuration of the lifting apparatus, the lift table is spaced at a first angle from the base, and wherein, while the wall module is supported on the lift table and the lifting apparatus is in the second configuration, the wall module is adapted to be hoisted off of the lift table. In one or more embodiments, in the first configuration of the lifting apparatus, the lift table: extends in a direction that is parallel to a direction of extension of the base; or is spaced at a second angle from the base, the second angle being smaller than the first angle. In one or more embodiments, in the second configuration of the lifting apparatus, the first angle by which the lift table is spaced from the base is greater than 45 degrees. In one or more embodiments, lifting apparatus further includes one or more pick points attached to the lift table; and the pick point(s) is/are configured so that a crane is adapted to be rigged to the pick point(s) to actuate the lifting apparatus from the first configuration to the second configuration. In one or more embodiments, the lifting apparatus further includes the crane. In one or more embodiments, the lifting apparatus further includes one or more hydraulic cylinders connected between the base and the lift table to actuate the lifting apparatus from the first configuration to the second configuration.

It is understood that variations may be made in the foregoing without departing from the scope of the present disclosure.

In one or more embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In one or more embodiments, while different steps, processes, and procedures are described as appearing as distinct acts, one or more of the steps, one or more of the processes, and/or one or more of the procedures may also be performed in different orders, simultaneously and/or sequentially. In one or more embodiments, the steps, processes, and/or procedures may be merged into one or more steps, processes and/or procedures. In one or more embodiments, one or more of the operational steps in each embodiment may be omitted. Moreover, in some instances, some features of the present disclosure may be employed without a corresponding use of the other features. Moreover, one or more of the embodiments disclosed above and in the Appendix of the '268 Application, or variations thereof, may be combined in whole or in part with any one or more of the other embodiments described above and in the Appendix, or variations thereof.

Although several embodiments have been described in detail above and in the Appendix of the '268 Application, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112(f) for any limitations of any of the claims herein, except for those in which the claim expressly uses the word "means" together with an associated function.

What is claimed is:

1. A lifting apparatus, comprising:

a base; and a lift table pivotably connected to the base, the lift table being configured to support a wall module, wherein the lifting apparatus is configured to be actuated, while the wall module is supported on the lift table, from a first configuration to a second configuration, wherein, in the second configuration of the lifting apparatus, the lift table is oriented at a first non-horizontal angle, wherein, in the first configuration of the lifting apparatus, the lift table is oriented:

at a horizontal angle; or at a second non-horizontal angle, the second non-horizontal angle being smaller than the first non-horizontal angle, and wherein, while the lifting apparatus is in the second configuration, the wall module is configured to be removed from the lift table.

2. The lifting apparatus of claim 1, wherein the first non-horizontal angle is greater than 45 degrees.

3. The lifting apparatus of claim 1, further comprising one or more pick points attached to the lift table;

wherein a crane is adapted to be rigged to the pick point(s) to actuate the lifting apparatus from the first configuration to the second configuration.

4. The lifting apparatus of claim 1, further comprising one or more hydraulic cylinders connected between the base and the lift table to actuate the lifting apparatus from the first configuration to the second configuration.

5. The lifting apparatus of claim 1, wherein, in the first configuration of the lifting apparatus, the lift table is oriented at the second non-horizontal angle; and wherein the second non-horizontal angle is equal to or less than 45 degrees.

6. A system, comprising:

a wall module configured to be supported on a lift table of a lifting apparatus;

the lifting apparatus, which lifting apparatus is configured to be actuated, while the wall module is supported on the lift table, from a first configuration to a second configuration, wherein the lift table is pivotably connected to a base of the lifting apparatus, wherein, in the second configuration of the lifting apparatus, the lift table is oriented at a first non-horizontal angle, wherein, in the first configuration of the lifting apparatus, the lift table is oriented:

at a horizontal angle; or at a second non-horizontal angle, the second non-horizontal angle being smaller than the first non-horizontal angle; and wherein, while the lifting apparatus is in the second configuration, the wall module is configured to be removed from the lift table.

7. The system of claim 6, wherein the first non-horizontal angle is greater than 45 degrees.

8. The system of claim 6, wherein one or more pick points are attached to the lift table; and wherein a crane is adapted to be rigged to the pick point(s) to actuate the lifting apparatus from the first configuration to the second configuration.

9. The system of claim 6, wherein the lifting apparatus includes one or more hydraulic cylinders connected between the base and the lift table to actuate the lifting apparatus from the first configuration to the second configuration.

10. The system of claim 6, wherein, in the first configuration of the lifting apparatus, the lift table is oriented at the second non-horizontal angle; and wherein the second non-horizontal angle is equal to or less than 45 degrees.

11. A method, comprising:

actuating, while a wall module is supported on a lift table of a lifting apparatus, the lifting apparatus from a first configuration to a second configuration, wherein the lift table is pivotably connected to a base of the lifting apparatus, wherein, in the second configuration of the lifting apparatus, the lift table is oriented at a first non-horizontal angle, and wherein, in the first configuration of the lifting apparatus, the lift table is oriented:

at a horizontal angle; or at a second non-horizontal angle, the second non-horizontal angle being smaller than the first non-horizontal angle;

and removing, while the lifting apparatus is in the second configuration, the wall module from the lift table.

12. The method of claim 11, wherein the first non-horizontal angle is greater than 45 degrees.

13. The method of claim 11, wherein one or more pick points are attached to the lift table; and wherein actuating the lifting apparatus from the first configuration to the second configuration comprises:

rigging a crane to the pick point(s); and lifting the lift table, via the pick point(s) and using the crane.

14. The method of claim 11, wherein the lifting apparatus includes one or more hydraulic cylinders connected between the base and the lift table; and wherein the lifting apparatus is actuated from the first configuration to the second configuration using the hydraulic cylinder(s).

15. The method of claim 11, wherein, in the first configuration of the lifting apparatus, the lift table is oriented at the second non-horizontal angle; and wherein the second non-horizontal angle is equal to or less than 45 degrees.

* * * * *